US007214272B2

(12) United States Patent
Hartung et al.

(10) Patent No.: US 7,214,272 B2
(45) Date of Patent: May 8, 2007

(54) DEVICE FOR COATING METAL BARS BY HOT DIPPING

(75) Inventors: Hans-Georg Hartung, Pulheim (DE); Walter Trakowski, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 164 days.

(21) Appl. No.: 10/500,676

(22) PCT Filed: Jan. 30, 2003

(86) PCT No.: PCT/EP03/00916

§ 371 (c)(1),
(2), (4) Date: Jul. 3, 2004

(87) PCT Pub. No.: WO03/072843

PCT Pub. Date: Sep. 4, 2003

(65) Prior Publication Data

US 2005/0120950 A1 Jun. 9, 2005

(30) Foreign Application Priority Data

Feb. 28, 2002 (DE) ..... 102 08 963

(51) Int. Cl.
*B05C 3/02* (2006.01)

(52) U.S. Cl. ..... 118/405; 118/419

(58) Field of Classification Search ..... 118/419, 118/405, 420, DIG. 18–DIG. 20, 429; 427/431, 427/436, 434.2

See application file for complete search history.

(56) References Cited

U.S. PATENT DOCUMENTS 4,275,098 A * 6/1981 Gunji et al. ..... 427/345
5,634,977 A * 6/1997 Ookouchi et al. ..... 118/423
5,665,437 A * 9/1997 Frommann et al. ..... 427/591

FOREIGN PATENT DOCUMENTS

DE 100 14 867 A1 9/2001
WO 9603533 2/1996

OTHER PUBLICATIONS

Patent Abstracts of Japan, vol. 017, No. 195 (C-1049), Apr. 16, 1993 & JP 04 346641 A (Kawasaki Steel Corp), Dec. 2, 1992.
Patent Abstracts of Japan, vol. 015, No. 145 (C-0823), Apr. 12, 1991 & JP 03 024254 A (Kawasaki Steel Corp) , Feb. 1, 1991.
Patent Abstracts of Japan, vol. 018, No. 242 (C-1197) , May 10, 1994 & JP 06 025815 A (Dai Ichi High Frequency Co Ltd) , Feb. 1, 1994.

* cited by examiner

*Primary Examiner*—Brenda A. Lamb
(74) *Attorney, Agent, or Firm*—Friedrich Kueffner

(57) ABSTRACT

The invention relates to a device for coating metal bars (1), particularly steel strips, by hot dipping. At least some sections of the metal bar (1) are vertically guided through a container receiving the molten coating metal (2), said metal bar (1) being guided by at least one roller (4) which runs on bearings. In order to increase the service life of the roller bearings, the roller, or at least the axis (5) thereof, penetrates the side walls (6) of the container (3) and is mounted outside the container (3).

8 Claims, 2 Drawing Sheets

DEVICE FOR COATING METAL BARS BY HOT DIPPING

The invention concerns a device for the hot dip coating of metal strands, especially steel strip, in which the metal strand can be vertically guided in at least some sections through a tank that contains the molten coating metal and in which the metal strand is guided by at least one roller that runs on bearings.

Conventional metal dip coating plants for metal strip, such as those described in EP 0 556 833 A1, have a high-maintenance part, namely, the coating tank and the fittings and fixtures it contains. Before being coated, the surfaces of the metal strip to be coated must be cleaned of oxide residues and activated to allow joining with the coating metal. For this reason, before being coated, the strip surfaces are subjected to a heat treatment in a reducing atmosphere. Since the oxide coatings are first removed chemically or abrasively, the surfaces are activated by the reducing heat-treatment operation in such a way that they are present in pure metallic form after the heat-treatment operation.

However, the activation of the strip surface increases the affinity of the strip surface for the surrounding atmospheric oxygen. To protect the strip surfaces from being exposed to atmospheric oxygen again before the coating operation, the strip is introduced into the hot dip coating bath from above in an immersion snout. Since the coating metal is in a molten state, and one would like to utilize gravitation together with blowing devices to adjust the coating thickness, but the subsequent operations prohibit strip contact until complete solidification of the coating metal has occurred, the strip must be deflected in the vertical direction in the coating tank. This is accomplished with a roller that runs in the molten metal. This roller is subject to intense wear by the molten coating metal and is the cause of shutdowns and thus production losses.

Due to the desired low coating thicknesses of the coating metal, which are on the order of micrometers, strict requirements must be placed on the quality of the strip surface. This means that the surfaces of the rollers that guide the strip must also be of high quality. Defects in these surfaces generally lead to defects in the surface of the strip. This is another reason for frequent shutdowns of the plant.

In addition, conventional hot dip coating plants have limiting values for the rate of coating. These limiting values pertain to the operation of the stripping jet, the cooling processes of the metal strip running through, and the heating process for adjusting alloy layers in the coating metal. This results in the situation that, for one thing, the maximum speed is generally limited, and, for another, certain types of metal strip cannot be run at the maximum speed possible for the plant.

Alloying operations for joining the coating metal with the strip surface occur during the hot dip coating operations. The properties and thicknesses of the alloy layers formed during these operations are strongly dependent on the temperature in the coating tank. For this reason, although the coating metal must be maintained in the liquid state in some coating operations, the temperature nevertheless may not exceed certain limits. Otherwise, this would conflict with the desired effect of the coating metal stripper for adjusting a certain coating thickness, since with decreasing temperature, the required viscosity of the coating metal for the stripping operation increases and thus makes the stripping operation more difficult.

To avoid the problems related to the rollers running in the liquid coating metal, there have been approaches that involve the use of a coating tank that is open at the bottom and has a guide channel in its lower region for guiding the strip vertically upward through the tank and the use of an electromagnetic seal to seal the opening. This involves the use of electromagnetic inductors, which operate with electromagnetic alternating or traveling fields, which force the liquid metal back or have a pumping or constricting effect and seal the coating tank at the bottom.

Solutions of this type are described, for example, in EP 0 673 444 B1, DE 195 35 854 A1, DE 100 14 867 A1, WO 96/03,533 A1, EP 0 854 940 B1, and JP 50[1975]-86446.

A problem associated with all of these solutions is that, under certain circumstances, there is insufficient stabilization or guidance of the metal strand in the coating bath. If rollers are used to eliminate this problem, as described, for example, in EP 0 556 833 A1, the problem of a short service life of the roller bearing in the aggressive liquid metal bath arises.

Therefore, the objective of the invention is the further development of a device of the type described above for the hot dip coating of metal strands in such a way that the specified disadvantages are overcome.

In accordance with the invention, this objective is achieved by providing that the roller or at least its shaft passes through the sidewalls of the tank and is supported in bearings outside the tank. The shafts or rollers brought out through the sidewalls may be the deflecting rollers and/or the stabilizing rollers or all of the rollers installed in the dip bath.

Sealing means are preferably provided in the area of the sidewall of the tank for sealing the coating material; they are preferably designed as electromagnetic inductors.

This refinement ensures in an advantageous way that the device for the hot dip coating of a metal strand guarantees optimum stabilization and guidance of the metal strand in the coating bath, but nevertheless that there is exact support of the guiding or stabilizing rollers with a long service life, since the bearing is no longer exposed to the aggressive dip bath.

A further development provides that the electromagnetic inductor is installed close to the coating metal. This allows its magnetic field to produce the greatest possible sealing effect. Both a traveling-field inductor and a "blocking-field" inductor can be used as the electomagnetic inductor.

The sealing effect of the inductor, by which the coating metal in the dip tank is held back, can be optimized if the section of the roller or roller shaft located in the area of the sidewall of the tank has a gradual recess. This recess is preferably formed as a hollow. In addition, it is advantageous if the section of the inductor adjacent to this recess of the roller or roller shaft is designed to geometrically complement this recess. Furthermore, to achieve the greatest possible blocking field, an electromagnetic coil can be installed in the area of the adjacent section of the inductor.

Optimum guidance and stabilization of the metal strand is achieved if the strand is guided by one roller on each side of the strand, i.e., by two rollers all together. The rollers preferably consist of ceramic material or are coated with a ceramic material. To achieve a high-quality coating operation in the bath, the rollers should also be connected to a rotational drive; the rollers are driven this way in the current case.

It is especially preferable to apply the idea of the invention to cases in which the metal strand can be guided vertically through the tank and through a guide channel upstream of the tank, such that at least one additional electromagnetic inductor is installed in the area of the guide channel to prevent the coating metal from flowing out at the bottom of the tank.

Embodiments of the invention are illustrated in the drawings.

Figure 2:
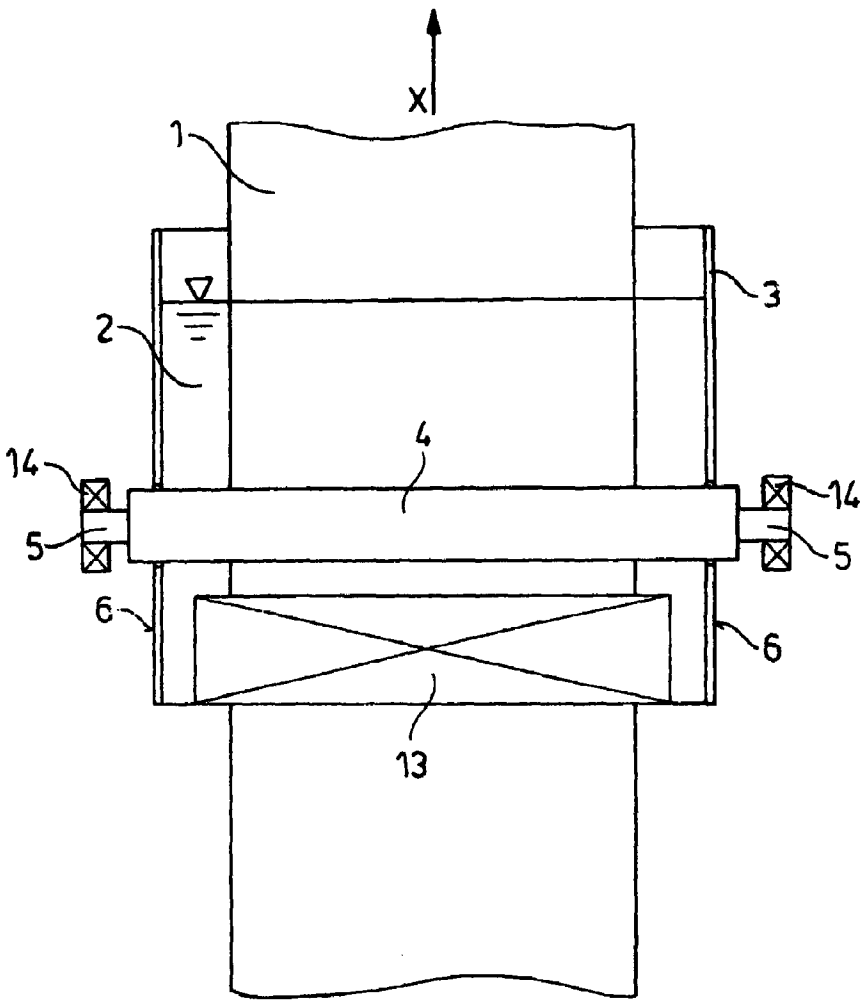
FIG. 2 shows the side view corresponding to FIG. 1.
Figure 1:
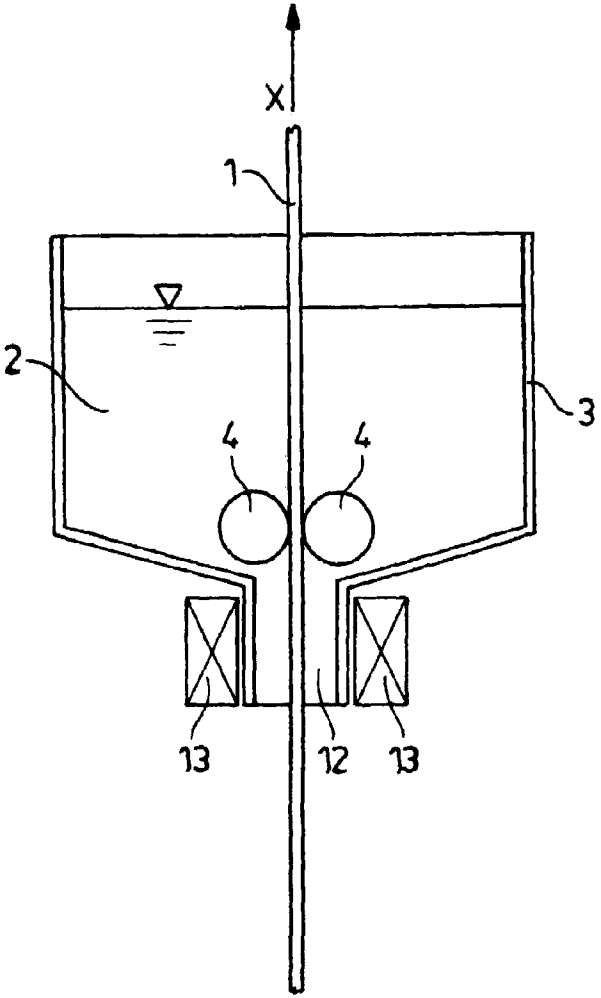
FIG. 1 shows a schematic front view of a hot dip coating tank with a metal strand being guided through it.

FIGS. 1 and 2 show the principle of the hot dip coating of a metal strand 1, especially a steel strip. In this embodiment, the metal strand to be coated enters a guide channel 12 of the coating plant vertically from below. The guide channel 12 forms the lower end of a tank 3, which is filled with molten coating metal 2. The metal strand 1 is guided vertically upward in the direction of movement X. To prevent the molten coating metal 2 from running out of the tank 3, an electromagnetic inductor 13 is installed in the area of the guide channel 12. It consists of two halves, which are installed on either side of the metal strand 1. An electromagnetic traveling field or blocking field is induced in the electromagnetic inductor 13. This field holds back the molten coating metal 2 in the tank 3 and prevents it from running out.

To provide good guidance and stabilization of the metal strand 1, two rollers 4 are installed in the tank 3 of coating metal 2, which are positioned above the inductor 13, i.e., they run in the molten coating metal 2.

As FIG. 2 shows, the rollers 4 pass through the sidewalls 6 of the tank 3. At their two axial ends, the rollers 4 have shaft sections 5 (roller shaft), which are supported in bearings 14 (roller bearings). Since the rollers are supported on bearings outside the tank 3, i.e., outside the coating metal 2, the bearing can be very exact and have very little play. In addition, the bearing has a long service life.

It should be noted that, of course, this design of the roller system and bearing can be used just as well if the metal strand is deflected in the tank 3, by which is meant, for example, an embodiment of the type described in EP 0 556 833 A1.

Due to the exact, low-clearance bearing of the rollers 4 in bearings 14 outside the tank 3, it is possible to keep the difference between the diameter of the opening in the tank wall 6 and the diameter of the roller 4 small. In the simplest case, if the gap of the roller opening is kept suitably small, this makes it possible for the coating metal 2 that flows out through the gap to be collected in a collecting tank without any additional measures, so that there are no further requirements with respect to the equipment to be able to carry out the coating process. In this case, it would only be necessary to make sure that the area of the outflowing metal is kept under a protective gas to prevent oxidation and the formation of undesirable impurities of the coating metal.

Figure 3:
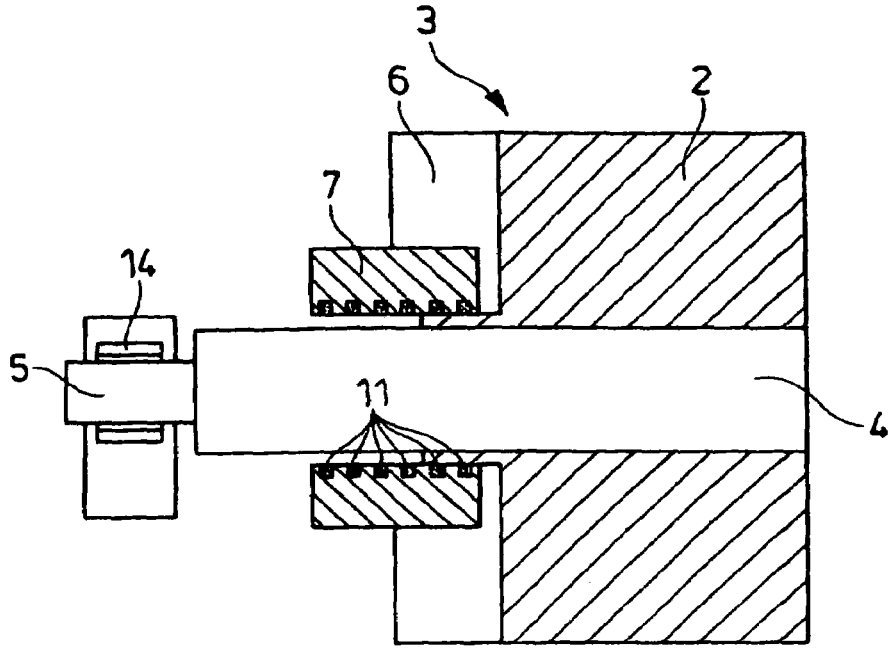
FIG. 3 shows a first embodiment of the sealing means between the roller and tank wall.
Figure 4:
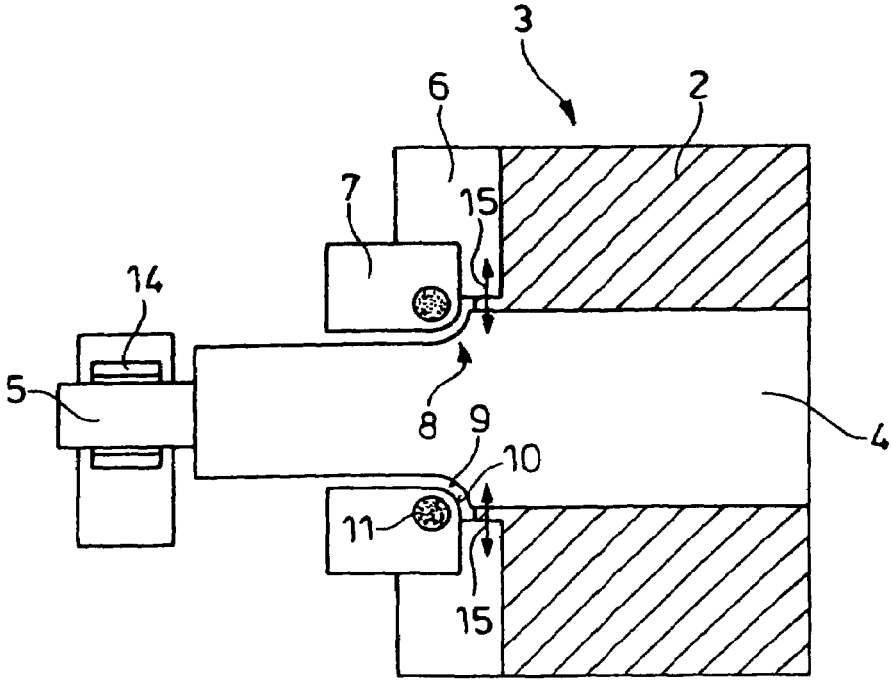
FIG. 4 shows an alternative embodiment with respect to the embodiment shown in FIG. 3.

However, it is preferable to proceed as shown in FIGS. 3 and 4.

FIGS. 3 and 4 show that an electromagnetic inductor 7 with one or more electromagnetic coils 11 is installed in the area of the sidewall 6 of the tank 3. The inductor 7 induces an electromagnetic field that holds back the coating metal 2 in the tank 3, and both a traveling field and a blocking field can be used. The inductor 7 acts as a sealing system.

In the solution shown in FIG. 3, an electromagnetic traveling field is used. Since the passage gap between the sidewall 6 and the roller 4 can be kept narrow due to the precise bearing of the roller 4, the field strength of the inductor 7 for sealing the gap can be significantly lower than the field strength necessary for sealing the bottom of the tank 3 where the strip passes through (see inductor 13 in FIGS. 1 and 2). The overall height of the inductor 7 can thus be reduced. The pumping effect of the traveling field produces a flow in the area of the passage of the roller 4 through the sidewall 6, which counteracts solidification of the coating metal 2 in the area of the passage of the roller 4 through the sidewall 6. Furthermore, as is evident from FIG. 3, the inductor 7 is positioned close to the coating metal 2 in the tank 3.

In the embodiment shown in FIG. 4, the inductor 7 is a "blocking-field" inductor that creates a constricting electromagnetic blocking field that is used for the magnetohydrodynamic sealing. The blocking force action of the magnetic field becomes fully effective if the lines of force of the induction field induced by the electromagnetic coil 11 are perpendicular to the direction of drainage of the coating metal 2.

Therefore, a special shape is provided for the roller 4 in the area of its section 8: In the embodiment shown here, the ceramic coating of the roller 4 has a recess 9 in the form of a hollow, and the inductor 7 has a matching, i.e., complementary, geometry in its section 10 adjacent to this recess. An electromagnetic coil 11 is installed in this section 10 of the inductor 7. In this way, the lines of force in the gap between the roller 4 and the sidewall 6 run perpendicularly to the direction of drainage of the coating metal 2 (see arrows 15).

Finally, it should also be noted that the proposed design of the arrangement of a roller in a coating bath can be used not only for stabilizing rollers, but also for sink rollers (e.g., for deflecting the metal strand).

LIST OF REFERENCE NUMBERS

1 metal strand
2 coating metal
3 tank
4 guide roller
5 roller shaft
6 sidewall of the tank 3
7 sealing means (inductor)
8 section of the guide roller 4
9 recess of the guide roller 4
10 section of the inductor 7
11 electromagnetic coil of the inductor 7
12 guide channel
13 inductor
14 roller bearing
15 direction perpendicular to the direction of drainage
X direction of movement

The invention claimed is:

1. Device for the hot dip coating of metal strands (1), especially steel strip, in which the metal strand (1) can be vertically guided in at least some sections through a tank (3) that contains the molten coating metal (2) and in which the metal strand (1) is guided by at least one roller (4) that runs on bearings, such that a section (8) of the at least one roller (4) or at least its shaft (5) passes through the sidewalls (6) of the tank (3) and is supported in bearings outside the tank (3), and such that sealing means are installed in the area of the sidewall (6) of the tank (3) for sealing the coating material (2), wherein the sealing means comprise at least one electromagnetic inductor (7), such that the section (8) of the roller (4) or the roller shaft (5) that is located in the area of the sidewall (6) of the tank (3) has a recess (9) that is formed as a hollow, wherein the device is further comprised of a guide channel (10) and at least one additional electromagnetic inductor (13) and wherein the metal strand (1) is guided vertically through the tank (3) and through the guide channel (12) upstream of the tank (3), such that the at least one additional electromagnetic inductor (13) is installed in the area of the guide channel (12).

2. Device in accordance with claim 1, wherein section (10) of the electromagnetic inductor (7) that is adjacent to the recess (9) of the roller or the roller shaft (5) is designed to geometrically complement the recess (9) and wherein at least one electromagnetic coil (11) is installed in the area of the adjacent section (10) of the electromagnetic inductor (7).

3. Device in accordance with claim 1, wherein the electromagnetic inductor (7) is installed near the coating metal (2).

4. Device in accordance with claim 1, wherein the electromagnetic inductor (7) is a traveling-field inductor.

5. Device in accordance with claim 1, wherein the electromagnetic inductor (7) is a blocking-field inductor.

6. Device in accordance with claim 1, wherein the at least one roller (4) comprises two rollers, and wherein the metal strand (1) is guided on both sides thereof by the two rollers (4).

7. Device in accordance with claim 1, wherein the at least one roller (4) consists of ceramic material or at least is coated with ceramic material.

8. Device in accordance with claim 1, wherein the at least one roller (4) is connected to a rotational drive.

* * * * *